United States Patent [19]

Hosemann et al.

[11] Patent Number: 4,968,360

[45] Date of Patent: Nov. 6, 1990

[54] PROCESS FOR DESLUDGING PHOSPHATING BATHS AND DEVICE FOR CARRYING OUT SAID PROCESS

[75] Inventors: Kurt Hosemann, Titz; Karl-Heinz Gottwald, Erftstadt; Willi Wuest, Ratingen; Hubert Harth, Hilden, all of Fed. Rep. of Germany

[73] Assignee: Gerhard Collardin GmbH, Koeln-Ehrenfeld, Fed. Rep. of Germany

[21] Appl. No.: 283,635

[22] Filed: Dec. 13, 1988

[30] Foreign Application Priority Data

Dec. 16, 1987 [DE] Fed. Rep. of Germany ..... 3742634

[51] Int. Cl.[5] ..... C23C 22/07

[52] U.S. Cl. ..... 148/253; 148/262

[58] Field of Search ..... 148/262, 253

[56] References Cited

U.S. PATENT DOCUMENTS 3,874,951 4/1975 Hill ..... 148/6.153
3,992,300 11/1976 Hill ..... 210/167

FOREIGN PATENT DOCUMENTS 2114161A 8/1983 European Pat. Off. .
3345498 6/1985 Fed. Rep. of Germany .
996418 6/1965 United Kingdom .
2080835 2/1982 United Kingdom .

*Primary Examiner*—Sam Silverberg
*Attorney, Agent, or Firm*—Ernest G. Szoke; Wayne C. Jaeschke; Norvell E. Wisdom, Jr.

[57] ABSTRACT

The development of sludge in phosphating baths is prevented by continuously diverting a partial volume of the baths into a separate device comprising three open chambers: an oxidation chamber where the solution is treated with an $O_2$-containing gas to oxidize the iron (II) of the solution of iron (III), which precipitates as phosphate; a conditioning chamber in which the iron (iii) phosphate precipitate formed in the oxidation chamber is agglomerated into a readily sedimented form; and a sedimentation chamber in which the sediment formed in the conditioning chamber is separated from the remaining liquid phosphating solution. This solution is then replenished with phosphate layer-forming components, and the replenished solution is subsequently recycled to the phosphating bath.

13 Claims, 2 Drawing Sheets

PROCESS FOR DESLUDGING PHOSPHATING BATHS AND DEVICE FOR CARRYING OUT SAID PROCESS

FIELD OF THE INVENTION

The invention relates to a process for desludging phosphating baths and a device for carrying out said process.

STATEMENT OF RELATED ART

In processes for applying phosphate coatings to metal surfaces, oxidizing components intended to accelerate layer formation on the metal surfaces are conventionally added to the zinc phosphate solutions employed for the application of the phosphate coating. In the course of the phosphation of iron and steel surfaces, iron is dissolved into the solution in the form of iron (II) ions, which, due to the presence of the oxidant in the phosphating bath, can be oxidized to form a precipitate, also called "sludge", of an insoluble iron (III) phosphate. During the use of the bath, the amount of iron (III) phosphate sludge in the phosphating bath increases. After some time, sludge components will deposit on the metal surfaces to be phosphated and will adversely affect the satisfactory formation of the phosphate layer. To avoid these adverse effects, after a longer or shorter period of time of use of the phosphating bath ("use life") the bath solutions will either have to be put out of use and the sludge, once settled, will have to be removed, or new solutions will have to be freshly prepared—the choice being dependent, inter alia, on the bath volume.

Usually, a phosphating bath only has a limited use life which depends on the material throughput. A bath cannot be used during a settling phase. On the other hand, the fresh preparation of the phosphating bath or portion thereof involves a considerable expense in chemicals. In addition, there is another disadvantage in that the iron phosphate sludge formed will always contain some amount of zinc phosphate solution. The disposal of zinc-containing sludges is not only rather expensive, but also involves ecological problems.

Many approaches have been described in prior art to ameliorate the problems associated with the occurrence of large amounts of iron phosphate in phosphating solutions. Thus, various compounds which do not affect the phosphating process are added to the baths in order to suppress sludge formation. For example, according to British Patent No. 996,418 urea is added, whereupon the temperature of the phosphating operation can be increased without having to put up with a substantially increased sludge formation. Hence, the throughput can be increased so that the use-life relative to the throughput is extended; nevertheless, in the course of time the same amount of iron phosphate sludge will be formed.

According to EP-A-0 045 110 an oxidizing accelerator such as $ClO_3^-$ is added to the phosphating baths in an amount which enables the iron (II) content of the solution to be adjusted between 0.05 and 1% by weight. The formation of sludge, however, is not thereby prevented and, thus, the problem is not generally solved.

In the German Offenlegungsschrift (published unexamined patent application) 33 45 498 it has been proposed, in a process for making phosphate coatings on iron or steel surfaces, to take precautions against sludge formation in the phosphating bath by drawing off a partial volume of the phosphating solution from the bath container and in a separate device adding an oxidant thereto in order to precipitate the iron phosphate, whereafter the iron phosphate sludge is removed by filtration prior to recycling the solution into the bath container. According to said publication, chlorate or hydrogen peroxide is used as the oxidant. While air was also considered as a possible oxidant, the use thereof was described as being impractical, because the oxidation by air would proceed too slowly, unless the procedure would be carried out under an elevated pressure. Since this would require the separate device to be pressure-resistant, the necessary expenses in equipment would render the process uneconomical.

DESCRIPTION OF THE INVENTION AND DRAWINGS

In the description herein, except in the operating examples, any numerical quantities representing amounts of ingredients or reaction conditions are to be understood as modified by the term "about".

It has surprisingly been found that it is readily possible to draw off iron (II)-containing phosphating solutions from the bath container and allow said solutions to react in a separate open device with air or another oxygen containing gas added thereto. One process embodiment of this invention prevents the concentration of iron (II) ions in the bath from rising to the critical value at which precipitation and subsequent sludge formation begin. Moreover, the process proceeds at such a rate that the iron phosphate sludge may be removed from the phosphating baths. As a consequence, the use-life of the phosphating baths can be extended indefinitely.

In a preferred embodiment of the invention, the drawn off volume of the phosphating solution is continuously fed into a separate device comprising three chambers, all at normal atmospheric pressure In the oxidation chamber of the device, the solution is treated with an $O_2$-containing gas. The iron phosphate sludge formed thereby is conditioned in a sludge-conditioning chamber and separated and removed in a sedimentation chamber. The solution thus treated, having been depleted in phosphate layer-forming components, is replenished with aqueous solutions which allow the acid ratio and the concentrations of components essential for phosphate formation to be adjusted, and the replenished solution is subsequently recycled to the phosphating bath.

The invention further includes a device for carrying out the above-described process, said device comprising separate chambers for the oxidation of the oxidizable bath components, devices for supplying the oxidant and for supplying, withdrawing, and moving the solution and for removing the iron phosphate sludge. A preferred embodiment of this device of the invention is depicted in the drawings, and it comprises the following equipment parts: An oxidation chamber 11 with a supply connection 12 and a gas-introducing member 13, a sludge-conditioning chamber 15 communicating with the oxidation chamber 11 via the overflow port 14, devices 16 for restraining the flow direction, a sedimentation chamber 19 communicating with the sludge-conditioning chamber 15 via an overflow port 18, allowing the sludge entrained by the flow to settle in a sludge hopper 20 with separate sludge outlet 23 and comprising a multiplicity of separating surfaces 24 arranged substantially in parallel with the flow direction.

The process according to the invention for desludging phosphating baths and the device provided according to the invention for carrying out the process are further illustrated in detail by the attached drawings, wherein FIG. 1 is a top plan view of a device according to the invention for carrying out the process;

Figure 1:
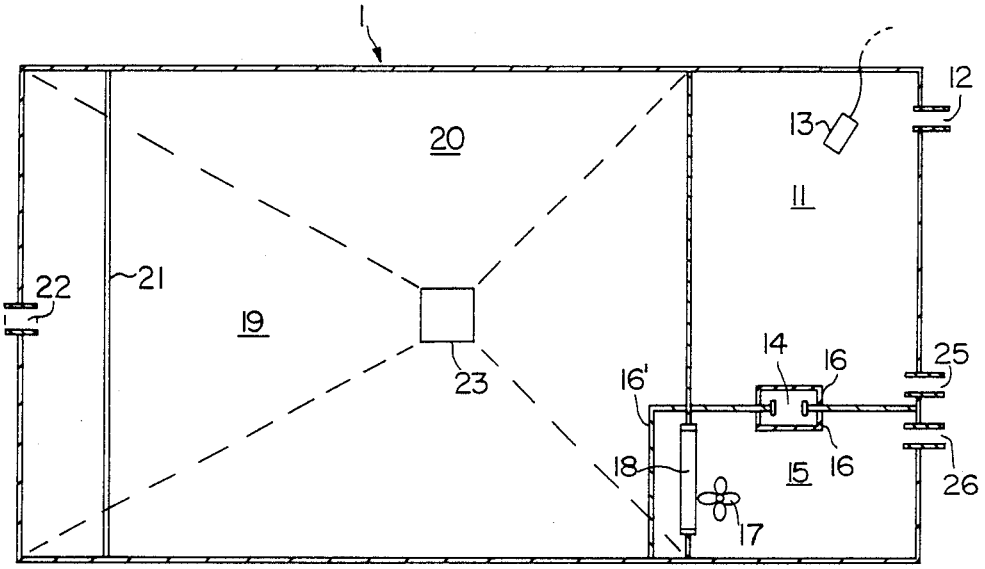

The process according to the invention is preferably used for removing sludge from phosphating baths working "on the side of the iron", viz. containing relatively weak oxidants or accelerators which convert only a low amount of the iron dissolved from the metal surface into the trivalent state and, thus, cause only a minor amount of sludge to be formed. Processes using such baths can deposit either thin or thick zinc-containing layers as desired in the phosphation of metal objects such as wire, tubes, or cold extrusion-molded parts.

The process according to the invention is a continuous process, which fact constitutes a substantial advantage over the processes described in prior art. Thus, it is now possible for the first time successfully to operate a separate sludge-removing device bypassing the phosphating bath and continuously to draw off and clear from sludge a partial volume of the phosphating solution from the bath container. The proportion by volume bypassed from the main phosphating bath through the device according to the invention depends on the bath and device dimensions. In a preferred embodiment, the separate device according to the invention is designed so that it is capable of drawing off and treating a partial volume of from 10 to 30% of the total volume of the phosphating bath. In a particularly preferred embodimentt said separate device is designed so that it is capable of allowing the total bath volume randomly to be passed through it once a day to oxidize dissolved iron (II) ions, precipitate iron (III) phosphate, and separate and remove the sludge of the latter. Thereby, the use life of a phosphating bath can be extended at will, and it is no longer necessary to discard the phosphating bath after some time when the sludge suspended in the bath diminishes the quality of the phosphate layers deposited, and to prepare a new phosphating bath in order to ensure the deposition of zinc-containing layers of the quality required.

The drawn-off partial volume of the phosphating solution, in a preferred first process step, is fed into the first chamber 11 of a separate device 1 comprising three chambers. The first chamber is designated as the "oxidation chamber" 11. The supply is effected via the feed inlet 12, the supplied amount being such that there is a steady-state condition with respect to the amount of purified phosphating solution effluent via the discharge port 22. According to the invention it is possible to adjust the supply of phosphating solution containing iron (II) and phosphate ions to an optimal volume flow rate which allows for complete oxidation of the iron ions contained in the solution, the precipitation thereof as iron (III) phosphate, and the complete separation by sedimentation of the iron phosphate-containing sludge formed.

In the oxidation chamber 11, the phosphating solution is treated with an $O_2$-containing gas. This mode of operation involves the advantage, over the addition of oxidants known from prior art for oxidizing iron (II) to iron (III), that no expensive chemicals are needed to cause the oxidation to take place. Moreover, the form of the iron (III) phosphate precipitating under the action of the oxidant is substantially dependent on the nature of the oxidant Thus, for example, if "hard" accelerators such as $NO_2$, $ClO_3$ or $H_2O_2$—as known from prior art—are added as oxidants, zinc-iron phosphate sludges take the form of large volume flakes floating in the solution and difficult to settle. If, however, so-called "soft" accelerators or oxidants are used, then well sedimentable particles of insoluble iron (III) phosphate are usually formed. A particular advantage inherent in the oxidation using an oxygen-containing gas is that very fine iron(III) phosphate particles are formed and settle at a very high rate, and thus may be readily sedimented. Moreover, this form of a sedimentable bath sludge has the advantage that its particles will include only relatively low amounts of phosphating solution containing layer-forming components so that the resulting bath sludge contains hardly any zinc. Hence, the zinc is retained in the phosphating bath.

In a preferred embodiment according to the invention, the $O_2$-containing gas is fed into the oxidation chamber 11 via a centrally supplied gas-introducing member 13 comprising a porous surface. This gas-introducing member may, for example, have a tubular basic shape, wherein the $O_2$-containing gas flows through the interior of the tube and penetrates to the outside through surface pores larger or lesser in size. Any material that is resistant to chemical attack by the phosphating solutions and available in a form with suitable porous walls may be used for the gas introducing member 13. Thus sintered glass and porous ceramics such as aluminum oxide are suitable materials for the gas introducing member. In order to avoid excessive pressure drop, materials with at holes at least 0.1 μm in size are generally preferred, although the oxidation process is more efficient, the smaller the holes. In a specially preferred embodiment, a sintered polypropylene tubing is employed as the gas-introducing member.

The sintered polypropylene tubing employed as the gas-introducing member 13 preferably has an average pore size of from 0.10 to 5.0 μm, polypropylene tubes having an average pore size of from 0.12 to 0.30 μm being used with particular advantage. Specifically, they have good permeability and ensure the formation of gas bubbles having a fineness as preferred for the oxidation process.

As the $O_2$-containing gas supplied to the oxidation chamber 11 through the gas-introducing member 13 there may be used, in preferred embodiments of the process, a gas selected from the group comprising pure $O_2$, air, and $O_2$-enriched air. Among these, air is particularly preferred for economic reasons and because it is readily available. The $O_2$-containing gas is supplied in such an amount that the elemental oxygen required for oxidation is supplied in an amount of from 0.01 to 100 mol/h. The supplied amount of gas of course will be adjusted to the flow rate of the phosphating solution through the device 1 according to the invention.

It should be noted that the oxidation reaction is effected at ambient pressure, which makes a significant difference from and establishes a great advantage over prior art. Thus, pressure-resistant equipment, deemed to be necessary in the prior art, is not required. Surprisingly, the reaction of the iron (II) ions with the $O_2$-containing gas causes the former to be mostly converted into iron (III) ions which are precipitated as iron(III) phosphate. This surprising result is believed to be due to the technique of gas introduction in the form of small bubbles, whereby the surface area at which the oxidation reaction takes place is substantially enlarged.

The oxidation reaction obeys the following reaction equation:

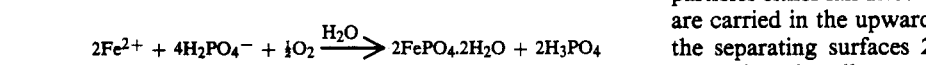

$$2Fe^{2+} + 4H_2PO_4^- + \tfrac{1}{2}O_2 \xrightarrow{H_2O} 2FePO_4.2H_2O + 2H_3PO_4$$

The insoluble iron (III) phosphate thus formed is the major constituent of the bath sludge. This bath sludge, together with the phosphating solution, is introduced from below to the device 16 for restraining the flow direction. This device 16 can be a so-called baffle located at some distance from the bottom of the oxidation chamber 11, from which chamber the sludge-containing solution flows upwardly through a channel between the a part of device 16 and the wall between the oxidation and sedimentation chambers. The sludge-containing solution leaves the oxidation chamber 11 through the overflow port 14 located between the oxidation chamber 11 and the sludge-conditioning chamber 15, and is passed downwardly into the sludge-conditioning chamber 15 by the device for restraining the flow direction 16. At the bottom end of the device 16 the flow enters the sludge-conditioning chamber 15.

In the sludge-conditioning chamber 15 the iron phosphate sludge is conditioned to render it more readily sedimentable. To this end, in the sludge conditioning-chamber 15 the solution containing the iron (III) phosphate sludge is stirred to cause any precipitates present in the form of flakes to agglomerate and to form grains which are more readily sedimentable. However, such grains must not exceed a certain size, because otherwise sludge sedimentation would occur to a significant extent in the sludge-conditioning chamber. A further advantageous effect of the stirring procedure in the sludge conditioning-chamber 15 is that the gaseous oxygen contained in the solution is more or less completely swept out, because it is physically driven from the solution and/or brought into contact, so as to complete reaction with, unreacted iron (II) constituents of the solution. This continuation of the oxidation reaction mainly taking place in the oxidation chamber 11 prevents such a reaction from again occurring in a later stage of the process and causing a solution rendered cloudy by subsequently precipitated iron (III) phosphate to run off from the discharge port 22.

Sufficient kinetic energy preferably is input to the sludge conditioning chamber to maintain turbulent flow conditions therein. More preferably a stirrer 17 as shown in the drawings is used for the major input of kinetic energy. It is most preferred to adjust the stirrer speed to from 100 to 300 rpm. At these speeds, well sedimentable sludges are generally formed and the oxygen-containing gas present in the solution is largely expelled.

The composition thus conditioned and comprising a phosphating solution containing well sedimentable sludge particles then flows through the overflow port 18 located between the sludge-conditioning chamber 15 and the sedimentation chamber 19 towards another device 16' for restraining the flow direction, for example, a so-called baffle, which directs the solution towards the bottom of the sedimentation chamber. Also here said device 16' is fixed at some slight distance from the bottom of the sedimentation chamber 19.

Due to the distinctly larger volume of the sedimentation chamber 19, the flow rate which had been accelerated due to the comparably small volume of the sludge-conditioning chamber 15 is decelerated. Thus in the sedimentation chamber the well sedimentable sludge particles either fall directly into the sludge hopper 20 or are carried in the upward direction and impact against the separating surfaces 24. These surfaces 24, which resemble a lamella separator, cause the flow rate to become relatively high in the space between the separating surfaces 24, while the flow rate is reduced in the vicinity of the separating surfaces, so that any upwardly flowing sludge particles will be intercepted by one of the surfaces 24 and will slide downwardly under the influence of gravity. When using this preferred embodiment of the process, nearly the total amount of the sludge will settle into the lower portion of the separation surface area so that it will not advance to even near the discharge port 22.

The well sedimentable sludge is successively accumulated in the sludge hopper 20 and may be withdrawn from the sedimentation chamber 19 by means of a separate sludge outlet 23. The solution freed of sludge is then advanced to the discharge port 22 over the overflow edge 21 which, for example, may be a conventional serrated ridge, and is removed through the discharge port 22 from the device according to the invention for desludging phosphating baths.

The resulting solution depleted in layer-forming components is replenished with aqueous solutions which allow the acid ratio and the concentrations of components essential for the layer formation to be adjusted. In preferred embodiments, the desludged solution is replenished with aqueous solutions such as to adjust the acid ratio (ratio of total acid : free acid) to a range of from 7 to 15 and the concentrations of phosphoric acid to a range of from 10 to 40 g.liter$^{-1}$, of nitric acid to a range of from 10 to 50 g.liter$^{-1}$, of $Ni^{2+}$ ions to a range of from 0 to 8 g.liter$^{-1}$, of $Cu^{2+}$ ions to a range of from 0 to 0.5 g.liter$^{-1}$, and of $Zn^{2+}$ ions to a range of from 3 to 30 g.liter$^{-1}$. It is preferred to use replenishing solutions which contain phosphoric acid in an amount of from 300 to 700 g.liter$^{-1}$, nitric acid in an amount of from 30 to 300 g.liter$^{-1}$, nickel (II) nitrate in an amount of from 0 to 50 g.liter$^{-1}$, $Cu(OH)_2.CuCO_3$ in an amount of from 0 to 3 g.liter$^{-1}$ and ZnO in an amount of from 100 to 300 g.liter$^{-1}$. As will be apparent from these numbers, the amount of zinc required for replenishing the solution is lower than in most solutions described in prior art for restoring the phosphating solutions, because by the process according to this invention, zinc is lost only to a very minor degree.

Upon replenishment of the desludged phosphating solution with the components required for the layer formation to the ranges considered as preferable and the simultaneous adjustment of the acid ratio to the preferred range of from 7 to 15, said desludged replenished aqueous solution is once more recycled to the phosphating bath. From the latter, in turn another partial volume is drawn off and in a continuous operation supplied to the separate device comprising three unpressurized chambers.

FIG. 1 is a top plan view of a device according to this invention for carrying out the process for desludging phosphating baths. According to FIG. 1, the device 1 substantially consists of three chambers, the first chamber 11 being designated as the oxidation chamber, the second chamber 15 being designated as the sludge-conditioning chamber, and the third chamber 19 being designated as the sedimentation chamber. All of said three chambers usually have different volumes. They have a volume ratio within the range of from 1 : 0.05 : 10 up to 1 : 1 : 1, and preferably a volume ratio of 1 : 0.5 : 5, the volumes being mentioned in the sequence of oxidation chamber 11—sludge-conditioning chamber 15—sedimentation chamber 19.

The partial volume drawn off from the phosphating solution to be desludged is fed to the oxidation chamber 11 via the feed inlet 12. In this chamber, an $O_2$-containing gas is introduced which is supplied to the oxidation chamber 11 by a gas-introducing member 13. The gas-introducing member preferably is a centrally supplied tubular member comprising a porous surface. Said member communicates with a pressure pump capable of supplying an $O_2$-containing gas, which is air in a preferred embodiment, to the gas-introducing member 13. It is particularly advantageous to employ a sintered polypropylene tubing as the gas-introducing member 13. Processes for sintering such propylene polymers and the products resulting therefrom have been known from prior art and do not require to be further explained here.

In practice, a tubing designated as Accurel-Rohr, PP by the company Enka AG has proven to be preferable. This commercial sintered polypropylene tube preferably has an average pore size within the range of from 0.10 to 5.0 μm, a pore size of from 0.12 to 0.30 μm being particularly preferred. This material is capable of supplying oxygen or an $O_2$-containing gas to the oxidation chamber 11 in the form of tiny gas bubbles. Such tiny gas bubbles are capable of effecting—contrary to statements set forth in prior art—a rapid, practical oxidation of the total amount of oxidizable iron (II) ions in the phosphating solution to form iron (III) which is subsequently precipitated as iron(III) phosphate. Therefore, pressure-resistant equipment is nowhere required. At atmospheric pressure in the oxidation chamber 11 of the apparatus 1, the gas bubbles of the $O_2$-containing gas will ascend and/or be dissolved into the aqueous phase until the concentration of oxygen reaches saturation at atmospheric pressure and the operation temperature, which usually is within the range of from 40° C. to 60° C.

In the course of continued supply of phosphating solution to be desludged, the oxygen-saturated and iron (III) phosphate-containing solution is passed via the device 16 for restraining the flow direction to the overflow port 14 located between the oxidation chamber 11 and the sludge-conditioning chamber 15 and therein forced in downward direction. In a preferred embodiment, the device 16 for restraining the flow direction comprises baffles having the form of an inverted U-shape, with the opening of the U located near the bottoms of the two chambers that the device connects solution stream. The inner surfaces of the U-shaped profiles of the device 16 face the overflow port 14, which is an opening in an otherwise solid wall between the two chambers 11 and 15. Thus on the side of the oxidation chamber 11 the solution flows in the direction from the bottom to the top toward the overflow port 14, while on the side of the sludge-conditioning chamber 15 the solution flows in the direction from the top to the bottom, thereby leaving the device 16 at the bottom end thereof to enter the sludge conditioning chamber 15.

The sludge-conditioning chamber 15 is equipped with a device 17 for stirring the solution. Said device 17 in a preferred embodiment consists of a controllable stirrer adjustable to a rotational speed of from 100 to 300 $min^{-1}$ (100 to 300 rpm). Once the sludge particles have been conditioned in the manner described above in the sludge-conditioning chamber 15, the sludge-containing solution leaves said sludge-conditioning chamber 15 via the overflow port 18 located at the top end thereof. Since in the sludge-conditioning chamber 15, due to its relatively low volume, the volume flow rate is relatively high, even those sludge particles which have been agglomerated to comparably large particles will be entrained and advanced by the stream. From the overflow port 18, the solution is passed in the downward direction through the device 16' for restraining the flow direction, which device preferably is also a baffle having the form of U-shaped profile, the inner surface of which faces the overflow port 18. Also this device 16' is fixed at a small distance from the bottom of the sedimentation chamber 19 so that the solution may enter the sedimentation chamber 19 at the bottom end thereof.

Figure 2:
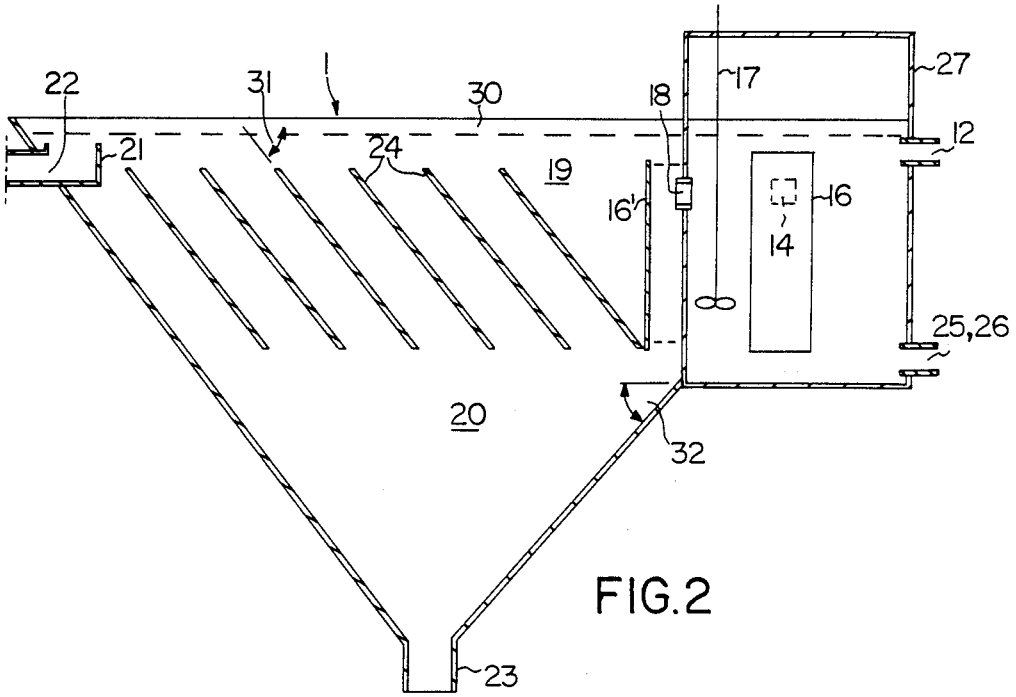
FIG. 2 is a longitudinal side view of the same device.
Figure 3:
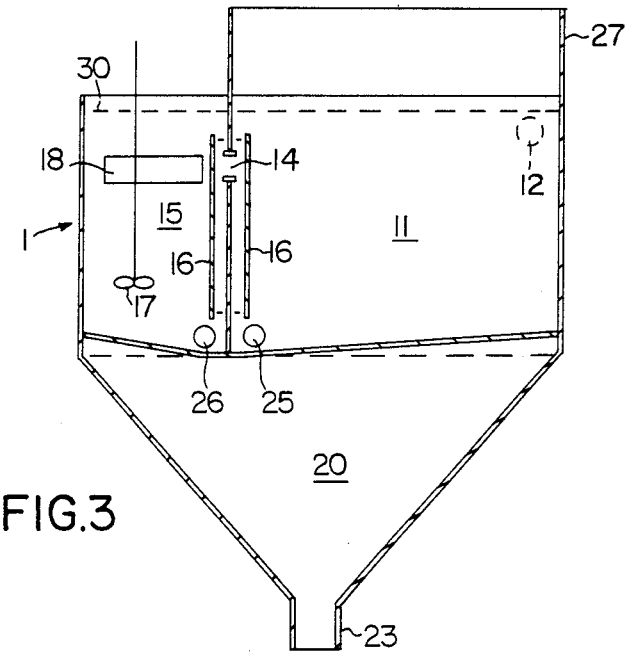
FIG. 3 is a transversal side view of the same device.

The path of the solution to this point will be apparent also from FIGS. 2 and 3, wherein the same parts of the device have been designated by the same reference numerals.

As will be best seen from FIG. 2, the solution comprising the conditioned sludge particles enters the sedimentation chamber 19 at the bottom of the device 16' for restraining the flow direction, where due to a larger chamber volume and to various possibilities of flow the flow rate of the solution is reduced from the flow rate in the sludge-conditioning chamber 15. Consequently, larger sludge particles may start to settle into the sludge hopper 20 immediately after entering the sedimentation chamber 19 and will never ascend to the separating surfaces 24 of the sedimentation chamber 19. Somewhat lighter sludge particles will be conveyed by the stream to the region between the separating surfaces 24 of the sedimentation chamber 19. As is generally known, the flow rate is more rapid in the region centrally between each two separating surfaces 24, whereas the flow rate decreases with increasing approach to the separating surfaces 24. The more or less heavy sludge particles are automatically advances to the regions of decreasing flow rate, that is towards the separating surfaces 24, and will settle thereon. Then, larger sludge particle agglomerates will slowly slide along the inclined separating surfaces 24 downwardly towards the sludge hopper 20.

It was found that an optimum sedimentation of sludge particles as desired is achieved with an inclination angle 31 between the separating surfaces 24 and the bath surface 30 of $\geqq 35°$ and with distances between each two separating surfaces 24 ranging from 5 to 30 cm. Thereby it will be ensured that no sludge remainders will be advanced to the top edges of the separating surfaces 24 or downstream beyond them.

In a preferred embodiment of the device according to the invention also the walls of the sludge hopper 20 exhibit an inclination angle 32 relative to the bath surface 30 or to an imaginary parallel thereto of $\geqq 35°$. Thereby the larger or smaller sludge granules will successively sink downwardly in the sludge hopper 20 to the sludge outlet 23 where they may settle and be separately withdrawn.

In a further preferred embodiment of the device according to the invention the sludge outlet 23 located at the bottom of the sludge hopper 20 has a pressure-cleaning device, not shown in the drawings, that can be used to remove crust build-up or deposits of iron phosphate sludge. To effect satisfactory cleaning, water may be supplied to the pressure-cleaning device, which may be, e.g., a cleaning nozzle operated with water under elevated pressure.

Figure 4:
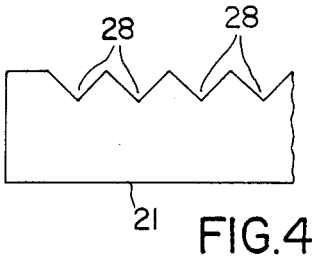
FIG. 4 is a detailed view of the overflow edge 21 that is schematically shown in FIGS. 1 and 2.

The aqueous bath medium freed of the sludge particles runs over the serrated ridge 21 which is shown in FIG. 4 in a relatively much higher magnification, and more specifically through the V-shaped valleys 28 of the serrated ridge 21, towards the discharge port 22. Therefrom, the sludge-free phosphating solution, after having been replenished with the components required for the phosphation, is recycled to the phosphation bath.

In a preferred embodiment, the device 1 according to the invention is manufactured of polypropylene. The major advantage of using polypropylene is that the material is completely hydrophobic and does not permit any polar components of the solution to settle on the surface of the device to cause build-up thereon. This is in contrast to conventional construction materials, whereon it had always to be expected that solution components would undergo chemical reactions with the device material, thereby causing irreversible changes of the materials resulting in malfunctions in the operation of the device. In particularly preferred embodiments, the polypropylene material of the device is completely smooth on the surface thereof contacting the solution components, so as to completely exclude any chance of mechanical attack on the surface by the components of the suspension, and more specifically by the granular iron (III) phosphate precipitates.

The device according to the invention, by itself or in combination with the above-described process, involves a number of process-technological advantages as already described. Another advantage not previously noted in detail is that in the course of the air oxidation only low amounts of zinc are precipitated from the solution (1 to 4% of $Zn^{2+}$ as compared to 8 to 15% in previously known prior art processes). Thus, maintaining the zinc ion concentration as necessary for the phosphation process requires the addition of a substantially lower amount of zinc oxide. Moreover, by way of the process according to the invention it became possible for the first time in a manner surprising for an artisan, to replenish the phosphation solutions by using suitable aqueous solutions for restoring the desired ratios and concentrations in the bath. Thereby it is ensured that the process parameters are kept constant throughout the entire phosphation procedure so that always accurately controlled phosphation layers are formed which are identical with respect to the layer compositions.

In addition, the process according to the invention and the treatment in the device as described above in greater detail also cause the iron(III) phosphate sludge obtained from the oxidation with fine bubbles of an oxygen-containing gas to be readily sedimentable so that it will not be distributed as usual in the form of voluminous flakes throughout the whole solution and tend to be floated off. During the treatment utilizing the fine bubbles of an oxygen-containing gas, there are formed granular finely disperse sludges the sedimentation properties of which are further improved by the conditioning step in the sludge-conditioning chamber 15.

A further advantage is that the amount of iron ions included in the phosphated layers is reduced over that of prior art. This is useful in those cases in which the phosphated parts are to be subjected to a subsequent drawing or pressing step and a soap-like drawing lubricant is applied to the phosphated surfaces. Such drawing lubricant substantially consists of alkali metal stearates. Now, the intended effects to be provided by such drawing lubricants are adversely affected by contamination with $Ca^{2+}$ ions (from hard water) and iron ions (due to increased iron concentrations in the phosphating baths), resulting in the formation of insoluble calcium and/or iron stearates. Metallic contamination by iron ions is prevented if the iron concentration is kept at a sufficiently low level due to the continuous precipitation of the dissolved iron in the form of iron (III) phosphate. Thus, with the phosphated products obtained from the baths treated according to the present invention the drawing lubricant may display its full effect.

The invention is further illustrated by the following non-limiting Examples.

EXAMPLE 1

Steel wire of grade 34 Cr Mo 4 was treated according to the process described below by successive immersion in the solutions described in the individual process steps:

a) Etching in 15% HCl at room temperature for 10 min;
b) Rinsing with industrial water at room temperature for 1 min;
c) Activation with an aqueous dispersion of titanium orthophosphate and polyphosphates (0.1%) at 40° C. for 10 min;
d) Phosphation with a 15% aqueous solution containing $Cu^{2+}$, $Ni^{2+}$, $Zn^{2+}$, phosphate and nitrate at 48° C. for 15 min;
e) Rinsing with industrial water at room temperature for 1 min;
f) Neutralization with an aqueous sodium borate/-sodium bicarbonate solution (0.1%) at 70° C.;
g) Lubricant application using an aqueous solution of sodium stearate (7%) at 85° C. for 15 min;
h) Drying in the air; and
i) Reduction of the wire through a drawing die to the specified size.

The freshly prepared phosphation solution contained the components $Zn^{2+}$, phosphate and nitrate in the following amounts:

21.1 g.liter$^{-1}$ of $Zn^{2+}$;
20.6 g.liter $^{-1}$ of phosphate; and
33.0 g.liter$^{-1}$ of nitrate.

To ensure that the total acid number (i.e., the amount in ml of 0.1N NaOH solution consumed in the titration of a 10 ml bath sample, diluted with water to 50 ml, against a 0.1% alcoholic phenolphthalein solution) was maintained and a uniform phosphation obtained, the phosphation solution was topped up with a replenishing solution having the following composition:

129 g.liter$^{-1}$ of $Zn^{2+}$;
410 g.liter$^{-1}$ of phosphate; and
43 g.liter$^{-1}$ of nitrate.

During the treatment of the wire the iron(II) contents of the bath was kept at a constant level of 3.0 g.liter$^{-1}$ by the continuous bypass operation of the invention as described above.

The apparatus according to the invention was run with the following operational parameters:

Volume flow rate of the bath solution: $\dot{V}_B$=380 liters/hr

Volume flow rate of compressed air: $\dot{V}_L$=2.0 m$^3$/hr.

Under these conditions, the iron (II) dissolved in the bypassed solution (400 g/hr) was converted into iron (III), precipitated as iron (III) phosphate and removed via the sludge outlet 23 of the sludge hopper 20 (cf. FIGS. 1, 2 and 3).

EXAMPLE 2

Cold-extruded articles made of the material $C_q$ 15 were treated according to the following procedure by successive immersion in the solutions described below:

a) Degreasing and cleaning with an aqueous strongly alkaline (NaOH) cleansing solution containing silicate and surfactant (5% by weight) at 85° C. for 15 min;
b) Rinsing with industrial water at room temperature for 1 min;
c) Rinsing with industrial water at 70° C. for 3 min;
d) Phosphation with a 15% aqueous solution containing $Cu^{2+}$, $Ni^{2+}$, $Zn^{2+}$, phosphate and nitrate at 55° C. for 15 min;
e) Rinsing with industrial water at room temperature for 1 min;
f) Neutralization with an aqueous sodium borate/-sodium bicarbonate solution;
g) Lubricant application using an aqueous solution of a mixture comprising sodium stearate and a mixture of long-chain fatty acids having from 12 to 18 carbon atoms (10%) at 85° C. for 10 min;
h) Drying in the air; and
i) Further processing on a press.

The initial phosphation solution contained the components $Zn^{2+}$, phosphate and nitrate in the following amounts:

18.0 g.liter$^{-1}$ of $Zn^{2+}$;
30.0 g.liter$^{-1}$ of phosphate; and
22.0 g.liter$^{-1}$ of nitrate.

The concentrations of the three above-mentioned components were maintained by topping up with a replenishing solution having the following composition:

192 g.liter$^{-1}$ of $Zn^{2+}$;
600 g.liter$^{-1}$ of phosphate; and
80 g.liter$^{-1}$ of nitrate.

By replenishing the bypassed solutions after passage through the apparatus according to the invention, the concentrations of all of said components could be kept at constant levels, as could be the total acid number. Thereby, a uniform quality of the phosphation layers was obtained.

The apparatus according to the invention was run with the following operational parameters:

Volume flow rate of the bath solution: $\dot{V}_B = 120$ liters/hr;

Volume flow rate of compressed air: $\dot{V}_L = 1$ m$^3$/hr.

From the phosphation solutions bypassed through the apparatus according to the invention, under the conditions set forth above 330 g of iron (II) per hour could be oxidized to form iron (III), precipitated as iron (III) phosphate, and removed as such via the sludge outlet 23 of the sludge hopper 20 (cf. FIGS. 1 to 3).

What is claimed is:

1. A process for reducing the formation of sludge during the use of phosphating solutions to deposit phosphate containing coatings on metal surfaces, comprising the steps of:

(a) continuously drawing off a partial volume of the phosphating solution, from the principal volume of the solution within which formation of phosphate coatings from the solution is occurring, into an oxidation chamber of a separate treating container that is sufficiently open to the ambient atmosphere to maintain the same pressure as the ambient atmosphere and that comprises distinct oxidation, conditioning, and sedimentation chambers through which the partial volume of solution passes continuously in succession;
(b) introducing into and dispersing within the partial volume of the phosphating solution in said oxidation chamber of said treating container sufficiently fine bubbles of an oxygen containing gas in sufficient quantity to cause substantially all the iron (II) content within the partial volume of the phosphating solution in the oxidation chamber to be oxidized to iron (III) and precipitated as iron (III) phosphate;
(c) passing the suspension of phosphating solution and precipitated iron (III) phosphate formed in step (b) into the conditioning chamber of the treating container and therein conditioning the precipitated iron (III) phosphate so as to increase its average sedimentation rate by the input of sufficient kinetic energy into said conditioning chamber so as to maintain the solution and suspended solids therein in a condition of turbulent flow;
(d) passing the suspension of phosphating solution and conditioned precipitated iron (III) phosphate formed in step (c) into the sedimentation chamber of the treating container and therein separating the phosphating solution remaining after the completion of step (c) from the precipitate conditioned therein;
(e) adding to the phosphating solution separated in step (d) a sufficient quantity of soluble phosphate film forming chemicals to restore the concentration of such phosphate film forming chemicals to a desired predetermined level; and
(f) continuously recycling the replenished desludged solution formed in step (e) to the principal phosphating volume and mixing it with the phosphating solution already present within said principal volume.

2. A process according to claim 1, wherein during continuous operation the partial volume of solution that is separated from the principal volume of the solution has a volume from about 10 to about 30% of the principal volume.

3. A process according to claim 2, wherein said three distinct chambers have relative volume ratios in the range from about 1 : 0.05 : 10 to about 1 : 1 : 1.

4. A process according to claim 3, wherein the $O_2$-containing gas is fed into the solution via a centrally supplied gas-introducing member comprising a porous surface of sintered polypropylene with pores of a size between about 0.10 to about 5 microns through which gas bubbles escape into the solution.

5. A process according to claim 4, wherein the oxygen containing gas is air, pure oxygen, or oxygen enriched air.

6. A process according to claim 5, wherein the principal volume of the phosphating solution has a composition having an acid ratio in a range of from about 7 to about 15 and a concentration of phosphoric acid in a range of from about 10 to about 40 g.liter$^{-1}$, of nitric acid in a range of from about 10 to about 50 g.liter$^{-1}$, of $Ni^{2+}$ ions in a range of up to about 8 g.liter$^{-1}$, of $Cu^{2+}$ ions in a range of up to about 0.5 g.liter$^{-1}$, and $Zn^{2+}$ ions in a range of from about 3 to about 30 g.liter$^{-1}$.

7. A process according to claim 6 wherein the replenishment of step (d) is accomplished by adding an appropriate volume of a replenisher solution which contains phosphoric acid in an amount of from about 300 to about 700 g.liter$^{-1}$, nitric acid in an amount of from about 30 to about 300 g.liter$^{-1}$, nickel(II) nitrate in an amount of up to about 50 g.liter$^{-1}$, $Cu(OH)_2.CuCO_3$ in an amount of up to about 3 g.liter$^{-1}$, and ZnO in an amount of from about 100 to about 300 g.liter$^{-1}$.

8. A process according to claim 7, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

9. A process according to claim 7, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

10. A process according to claim 6, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

11. A process according to claim 4, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

12. A process according to claim 3, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

13. A process according to claim 2, wherein said third distinct chamber includes (i) a bottom settling zone having side walls arranged at an angle of at least 35 degrees to the surface of the upper liquid in this chamber; (ii) a device for constraining the flow of phosphating solution and conditioned suspended solids to enter the third chamber at a point above the bottom settling zone but below an upper separation zone, (iii) a plurality of baffles, arranged at an angle of at least 35 degrees to the upper surface of the liquid in the third chamber and so disposed within the chamber and sufficiently closely spaced that any particle of suspended iron (III) phosphate that remains in the solution within the separation zone of the chamber will be impeded by at least one baffle in any vertical flow path from the bottom of the separation zone to the top thereof, and (iv) a device for preventing the exit from the third chamber of any liquid that has not reached the top of the plurality of baffles.

* * * * *